US008262818B2

(12) United States Patent
Nonaka et al.

(10) Patent No.: US 8,262,818 B2
(45) Date of Patent: Sep. 11, 2012

(54) METHOD FOR PRODUCING HIGH STRENGTH STEEL SHEET EXCELLENT IN FORMABILITY

(75) Inventors: Toshiki Nonaka, Tokai (JP); Hirokazu Taniguchi, Tokai (JP); Masaaki Mizutani, Tokai (JP); Nobuhiro Fujita, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/066,223

(22) Filed: Apr. 8, 2011

(65) Prior Publication Data

US 2011/0186185 A1 Aug. 4, 2011

Related U.S. Application Data

(62) Division of application No. 10/560,989, filed as application No. PCT/JP03/08006 on Jun. 24, 2003, now Pat. No. 7,922,835.

(30) Foreign Application Priority Data

Jun. 19, 2003 (JP) ..... 2003-175093

(51) Int. Cl.
*C21D 8/02* (2006.01)

(52) U.S. Cl. ..... 148/603; 148/652; 148/505

(58) Field of Classification Search ..... 148/603, 148/652, 533, 320, 505; 428/659
See application file for complete search history.

(56) References Cited

FOREIGN PATENT DOCUMENTS

| | | | |
|---|---|---|---|
| EP | 0748874 | A1 | 12/1996 |
| EP | 0750049 | A1 | 12/1996 |
| EP | 0796928 | A1 | 9/1997 |
| EP | 1154028 | | 11/2001 |
| EP | 1431406 | A1 | 6/2004 |
| JP | 57-155329 | | 9/1982 |
| JP | 61-157625 | | 7/1986 |
| JP | 05-247586 | | 9/1993 |
| JP | 10-130776 | | 5/1998 |
| JP | 2000256788 | A | 9/2000 |
| JP | 2000-345288 | | 12/2000 |
| JP | 2001-234281 | | 8/2001 |
| JP | 2003-105513 | | 4/2003 |
| JP | 2003-193192 | | 7/2003 |
| JP | 2003-239040 | | 8/2003 |

OTHER PUBLICATIONS

Olaf Maid et al., Einfluss der Hrstellungsbedingungen von Wrm- und Kltband and die Gefugeausbildung und die mechanischen eigenschaften von Dalphasen- Stahl, Stahl und Eisen, vol. 108, No. 8, Apr. 18, 1988, pp. 31-36.

*Primary Examiner* — Deborah Yee
(74) *Attorney, Agent, or Firm* — Kenyon & Kenyon LLP

(57) ABSTRACT

A high strength steel sheet excellent in formability which has a chemical composition in mass %: C: 0.03 to 0.20%, Si: 0.005 to 0.3%, Mn: 1.0 to 3.1%, P: 0.001 to 0.06%, S: 0.001 to 0.01%, N: 0.0005 to 0.01%, Al: 0.2 to 1.2%, Mo≦0.5%, and the balance: Fe and inevitable impurities, with the proviso that the values of mass % for Si and Al satisfy the following formula (1):

$$(0.0012\times[\text{objective value of TS}]-0.29-[\text{Si}])/2.45<\text{Al}<1.5-3\times[\text{Si}] \quad (1)$$

wherein [objective value of TS] represents a design strength value for the steel sheet in an Mpa unit, and has a metal structure containing ferrite and martensite. The above high strength steel sheet is also excellent in formability and the capability of being chemically treated and that of being hot-dip zinc sheeted.

9 Claims, 3 Drawing Sheets

[C:0.12%,Si:0.05%,Mn:2.0%,P:0.007%,Al:0.5%]

[C:0.12%,Si:0.05%,Mn:2.0%,P:0.007%,Al:0.5%]

METHOD FOR PRODUCING HIGH STRENGTH STEEL SHEET EXCELLENT IN FORMABILITY

This application is a divisional application under 35 U.S.C. §120 and §121 of U.S. patent application Ser. No. 10/560,989, filed Dec. 14, 2005, now U.S. Pat. No. 7,922,835 which is a 35 U.S.C. §371 of International Application No. PCT/JP2003/008006 filed Jun. 24, 2003, which claims priority to Japanese Patent Application. Nos. 2003-175093 filed Jun. 19, 2003, 2001-394003 filed Dec. 26, 2001, and 2002-036193 filed Feb. 14, 2002, which are incorporated by reference herein in their entireties.

TECHNICAL FIELD

The present invention relates to a high strength steel sheet excellent in formability, chemical converted coating treatment and galvanization, and a method for producing the steel sheet.

BACKGROUND ART

Recently, the reduction of weight of automobile bodies has increasingly been demanded with the aim of improving the fuel efficiency of automobiles. One of the measures to reduce an automobile body weight is to use a steel material having a high strength. However, as the strength of a steel material increases, the press forming of the steel material becomes increasingly difficult. This is because, generally, as the strength of a steel material increases, the yield stress of the steel material increases and, further, the elongation thereof decreases.

To cope with the above problem, a steel sheet that makes use of strain induced transformation of retained austenite (hereunder referred to as "TRIP steel"), and the like, have been invented to improve elongation and these technologies are disclosed in Japanese Unexamined Patent Publications No. S61-157625 and No. H10-130776, for example.

However, an ordinary TRIP steel sheet inevitably requires a large amount of Si to be contained, as a result the performance of chemical conversion treatment and hot-dip galvanization on the surface of the steel sheet deteriorates and, therefore, the members to which the steel sheet is applicable are limited. In addition, in a retained austenite steel, a large amount of C must be added in order to secure a high strength and, as a result, problems of welding, such as nugget cracks, arise.

With regard to the performance of chemical conversion treatment and hot-dip galvanization on the surface of a steel sheet, inventions that aim to reduce the Si amount in a retained austenite TRIP steel are disclosed in Japanese Unexamined Patent Publications No. H5-247586 and No. 2000-345288. However, through the inventions, though an improvement of the performance of chemical conversion treatment and hot-dip galvanization, as well as ductility, can be expected, an improvement in the aforementioned weldability cannot be expected. Moreover, in the case of a TRIP steel of 980 MPa or more in tensile strength, the yield stress is very high and, therefore, the problem has been that the shape freezing property of the steel deteriorates at the time of pressing or the like. Further, in the case of a high strength steel sheet of 980 MPa or more in tensile strength, the occurrence of delayed fracture is a concern. Another problem is that, as a TRIP steel sheet contains a large amount of retained austenite, voids and dislocations are formed, in quantity, at the interface between a martensite phase formed by strain induced transformation and other phases in the vicinity of the martensite phase, hydrogen accumulates the interface and, then, delayed fracture occurs.

Further, as a technology of reducing a yield stress, a dual phase steel (hereunder referred to as "DP steel") containing ferrite has so far been known as disclosed in Japanese Unexamined Patent Publication No. S57-155329. However, the technology requires that a cooling rate after recrystallization annealing is 30° C./sec. or more and the cooling rate is insufficiently achieved in an ordinary hot-dip galvanizing line. Furthermore, the target tensile strength of the steel sheet is 100 kg/mm$^2$ at the highest and therefore a high strength steel sheet having sufficient formability has not always been realized.

DISCLOSURE OF THE INVENTION

The object of the present invention is, by solving the aforementioned problems of the prior art, to realize a high strength steel sheet excellent in formability and the performance of chemical conversion treatment and galvanization, and a method for producing the steel sheet in an industrial scale.

The present inventors, as a result of earnestly studying a high strength steel sheet excellent in formability, have found that, in the case of a DP steel having a low yield stress, a high strength steel sheet capable of securing an elongation higher than before can be produced industrially by optimizing the steel components and, namely, by regulating the balance between the amounts of Si and Al and the value of TS (a target strength) to specific ranges and, particularly, by adjusting the addition amount of Al.

By the present invention, realized is a high strength steel sheet wherein ductility is improved to an extent comparable with, or similar to, a conventional retained austenite steel, chemical converted coating treatment and hot-dip galvanization is improved by reducing Si and, moreover, the properties are less deteriorated even when alloying plating is applied.

Further, the present invention provides a DP steel that allows retained austenite to be unavoidably included at 5% or less and substantially does not contain retained austenite so as not to incur the problems of delayed fracture and secondary working embrittlement.

The tensile strength of a high strength steel sheet according to the present invention ranges from 590 to 1,500 MPa and the effects of the present invention are particularly conspicuous with a high strength steel sheet of 980 MPa or more.

The present invention is based on the above technological concept and the gist of the present invention is as follows:

(1) A high strength steel sheet excellent in formability, chemical converted coating treatment and hot-dip galvanizing, characterized in that: said steel sheet contains, in mass, 0.03 to 0.20% C,
0.005 to 0.3% Si,
1.0 to 3.1% Mn,
0.001 to 0.06% P,
0.001 to 0.01% S,
0.0005 to 0.01% N,
0.2 to 1.2% Al, and
not more than 0.5% Mo, with the balance consisting of Fe and unavoidable impurities; the amounts of Si and Al in mass % and the target strength (TS) of said steel sheet satisfy the following expression (1); and the metallographic structure of said steel sheet contains ferrite and martensite;

$$(0.0012\times[\text{target strength TS}]-0.29-[\text{Si}])/2.45<\text{Al}<1.5-3\times[\text{Si}] \quad (1)$$

where, [target strength TS] is the designed strength of said steel sheet in terms of MPa and [Si] is the amount of Si in terms of mass %.

(2) A high strength steel sheet according to the item (1), characterized by further containing, in mass, one or more of 0.01 to 0.1% V, 0.01 to 0.1% Ti and 0.005 to 0.05% Nb.

(3) A high strength steel sheet according to the item (1) or (2), characterized by: further containing 0.0005 to 0.002 mass % B; and satisfying the following expression (2), $$500\times[B]+[Mn]+0.2[Al]<2.9 \quad (2)$$

where, [B] is the amount of B, [Mn] that of Mn, and [Al] that of Al, each in terms of mass %.

(4) A high strength steel sheet according to any one of the items (1) to (3), characterized by further containing, in mass, one or both of 0.0005 to 0.005% Ca and 0.0005 to 0.005% REM.

(5) A high strength steel sheet excellent in formability, chemical converted coating treatment and hot-dip galvanizing, characterized in that ferrite grains, wherein the ratio of the breadth to the length of each said ferrite grain is 0.2 or more, account for not less than 50% of the total ferrite grains in said high strength steel sheet according to any one of the items (1) to (4).

(6) A high strength steel sheet according to any one of the items (1) to (5), characterized in that said steel sheet is a hot-rolled steel sheet or a cold-rolled steel sheet.

(7) A high strength steel sheet according to any one of the items (1) to (6), characterized in that hot-dip galvanizing treatment is applied to said steel sheet.

(8) A method for producing a high strength steel sheet according to any one of the items (1) to (7), characterized in that said steel sheet is produced through the processes of: hot rolling at a finishing temperature of the $Ar_3$ transformation temperature or higher; coiling at 400° C. to 550° C.; successively applying ordinary pickling; thereafter primary cold rolling at a reduction ratio of 30 to 70%; then recrystallization annealing in a continuous annealing process; and successively skin-pass rolling.

(9) A method for producing a high strength steel sheet according to the item (8), characterized in that, in said annealing process, said steel sheet is: heated to a temperature in the range from the $Ac_1$ transformation temperature to the $Ac_3$ transformation temperature+100° C.; retained for 30 sec. to 30 min.; and thereafter cooled to a temperature range of 600° C. or lower at a cooling rate of not less than X° C./sec., X satisfying the following expression (3), $$X\geqq(Ac_3-500)/10^{a} \quad (3)$$

$$a=0.6[C]+1.4[Mn]+3.7[Mo]-0.87,$$

where, X is a cooling rate in terms of ° C./sec., $Ac_3$ is expressed in terms of ° C., [C] is the amount of C, [Mn] that of Mn, and [Mo] that of Mo, each in terms of mass %.

BEST MODE FOR CARRYING OUT THE INVENTION

Figure 1:
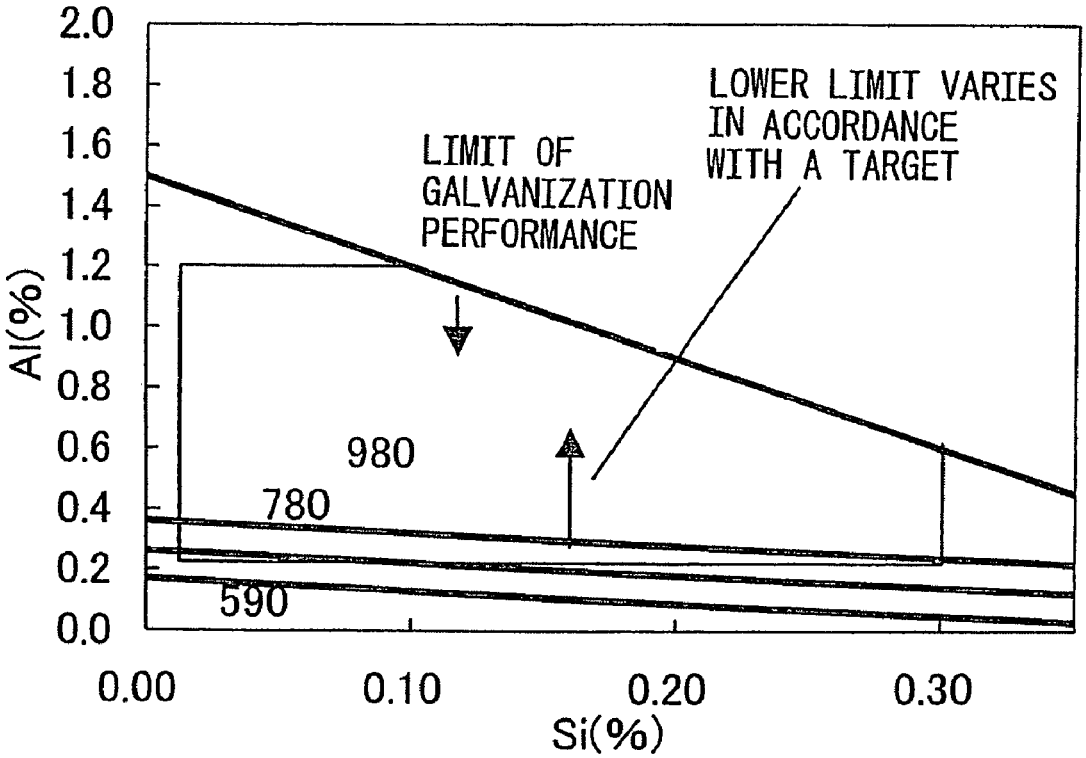
FIG. 1 is a graph showing the ranges of Al and Si for each target strength TS.

The embodiments of the present invention will be hereunder explained in detail.

Firstly, the reasons for regulating the chemical components and the metallographic structure of a high strength steel sheet according to the present invention will be explained.

C is an essential component from the viewpoint of securing strength and as the basic element to stabilize martensite. When a C amount is less than 0.03%, the strength is insufficient and a martensite phase is not formed. On the other hand, when a C amount exceeds 0.2%, strength increases excessively, ductility is insufficient, weldability deteriorates, and therefore the steel cannot be used as an industrial material. For those reasons, a C amount is regulated in the range from 0.03 to 0.2%, preferably from 0.06 to 0.15%, in the present invention.

Mn must be added from the viewpoint of securing strength and, in addition, is an element that delays the formation of carbides and is effective for the formation of ferrite. When an Mn amount is less than 1.0%, strength is insufficient, the formation of ferrite is also insufficient, and ductility deteriorates. On the other hand, when an Mn amount exceeds 3.1%, hardenability increases more than necessary, as a result martensite is formed abundantly and, thus, strength increases, as a result the variation of product quality increases, ductility is insufficient, and therefore the steel cannot be used as an industrial material. For those reasons, an Mn amount is regulated in the range from 1.0 to 3.1% in the present invention.

Si is an element that is added from the viewpoint of securing strength and generally to secure ductility. However, when Si is added in excess of 0.3%, the chemical converted coating treatment and hot-dip galvanization deteriorates. Therefore, an Si amount is set at 0.3% or less in the present invention, and further, when importance is placed on hot-dip galvanization, a preferable Si amount is 0.1% or less. Furthermore, Si is added as a deoxidizer and for the improvement of hardenability. However, when an Si amount is less than 0.005%, the deoxidizing effect is insufficient. Therefore, the lower limit of an Si amount is set at 0.005%.

P is added as an element to strengthen a steel sheet in accordance with a required strength level. However, when the addition amount of P is large, P segregates at grain boundaries and, as a result, local ductility deteriorates. Further, P also deteriorates weldability. Therefore, the upper limit of a P amount is set at 0.06%. The lower limit of a P amount is set at 0.001%, because the decrease of a P amount beyond the figure causes the refining cost to increase at the stage of steelmaking.

S is an element that forms MnS and, by so doing, deteriorates local ductility and weldability, and therefore it is better that S does not exist in a steel. For that reason, the upper limit of an S amount is set at 0.01%. The lower limit of an S amount is set at 0.001%, because, like P, decreasing an S amount beyond this figure causes a refining cost to increase at the stage of steelmaking.

Al is the most important element in the present invention. The addition of Al accelerates the formation of ferrite and improves ductility. In addition, Al is an element that does not deteriorate the performance of chemical conversion treatment and hot-dip galvanization even when Al is added in quantity. Furthermore, Al functions also as a deoxidizing element. An Al addition of 0.2% or more is necessary for the improvement of ductility. On the other hand, when Al is added excessively, the above effects are saturated and rather a steel becomes brittle. For that reason, the upper limit of an Al amount is set at 1.2%

N is an element that is unavoidably included. When N is contained excessively, not only an aging property deteriorates but also the amount of precipitated AlN increases and the effect of Al addition is reduced. For that reason, a preferable N amount is 0.01% or less. On the other hand, excessive reduction of an N amount causes the cost to increase in a steelmaking process and, therefore, it is generally preferable to control an N amount to about 0.0005% or more.

In general, large amounts of alloying elements must be added in order to produce a steel sheet having a high strength and in which the formation of ferrite is suppressed. For that reason, the fraction of ferrite in a structure decreases, the fraction of the second phase increases, and therefore elongation decreases considerably particularly in a DP steel of 980 MPa or more. To cope with this, the measures of the addition of Si and the reduction of Mn are mostly taken. However, the former measure causes the performance of chemical conversion treatment and hot-dip galvanization to deteriorate, the latter measure causes a strength to be hard to secure and, therefore, these measures are not usable for a steel sheet as intended in the present invention. In this light, the present inventors, as a result of intensive studies, found that when the amounts of Al, Si and the value of TS were controlled so as to satisfy the following expression (1), a sufficient ferrite fraction was secured and an excellent elongation was secured;

$$(0.0012\times[\text{target strength TS}]-0.29-[\text{Si}])/2.45<\text{Al}<1.5-3\times[\text{Si}] \quad (1)$$

where [target strength TS] was the designed strength of the steel sheet in terms of MPa and [Si] was the amount of Si in terms of mass %.

As shown in FIG. 1, when an addition amount of Al is less than the value of (0.0012×[target strength TS]−0.29−[Si])/2.45, the amount of Al is insufficient for improving ductility and, in contrast, when it exceeds 1.5−3×[Si], the performance of chemical conversion treatment and hot-dip galvanization deteriorates.

The reason why a metallographic structure contains ferrite and martensite as a feature of the present invention is that a steel sheet excellent in the balance between strength and ductility can be obtained by forming such a metallographic structure. The ferrite cited here means polygonal ferrite and banitic ferrite. The martensite cited here includes martensite that is obtained by ordinary quenching and that is obtained by tempering at a temperature of 600° C. or lower, and even the latter martensite shows the identical effect. When austenite remains in a structure, secondary working brittleness and delayed fracture deteriorate. For that reason, a steel sheet according to the present invention allows retained austenite to be unavoidably included in an amount of 3% or less and substantially does not contain retained austenite.

Mo is an element that is effective in securing strength and hardenability. However, an excessive addition of Mo sometimes causes the formation of ferrite to be suppressed, ductility to deteriorate and the performance of chemical conversion treatment and hot-dip galvanization also to deteriorate in a DP steel. For that reason, the upper limit of Mo is set at 0.5%.

V, Ti and Nb may be added in the ranges from 0.01 to 0.1%, from 0.01 to 0.1% and from 0.005 to 0.05%, respectively, for the purpose of securing strength.

B may be added in the range from 0.0005 to 0.002% for the purpose of securing hardenability and the increase of an effective Al by BN. By raising a ferrite fraction, an excellent elongation is secured but there are cases where a laminar structure is formed and local ductility deteriorates. The present inventors found that the above drawback could be avoided by adding B.

Figure 2A:
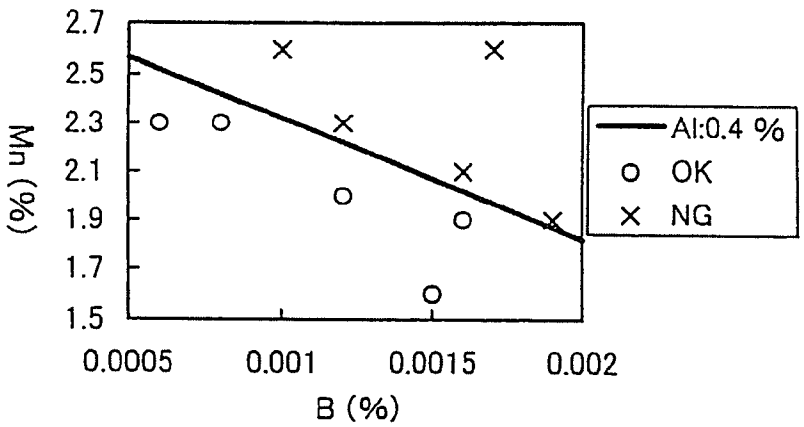
FIG. 2 (*a*) is a graph showing the relationship between the performance of chemical conversion treatment and hot-dip galvanization and the amounts of Mn and B in the case of 0.4% Al, and FIG. 2 (*b*) is a graph showing the relationship between the performance of chemical conversion treatment and hot-dip galvanization and the amounts of Mn and B in the case of 1.2% Al.
Figure 2B:
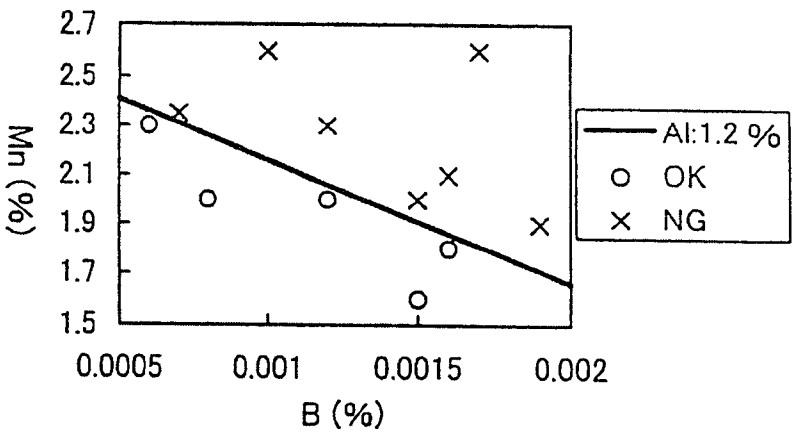

However, the oxides of B deteriorate the performance of chemical conversion treatment and hot-dip galvanization. It was also found that, likewise, Mn and Al deteriorated the performance of chemical conversion treatment and hot-dip galvanization when they were added in quantity. The present inventors studied the above findings and further found that, as shown in FIGS. 2 (*a*) and (*b*), when a steel sheet contained B, Mn and Al so as to satisfy the relation shown in the following expression (2), sufficient performance of chemical conversion treatment and hot-dip galvanization could be obtained;

$$500\times[\text{B}]+[\text{Mn}]+0.2[\text{Al}]<2.9 \quad (2)$$

where, [B] was the amount of B, [Mn] that of Mn, and [Al] that of Al, each in terms of mass %.

Ca and REM may be added in the ranges from 0.0005 to 0.005% and from 0.0005 to 0.005%, respectively, for the purpose of controlling inclusions and improving hole expansibility.

Sn and others are contained in a steel sheet as unavoidably included impurities and, even when those impurity elements are contained in the range of 0.01 mass % or less, the effects of the present invention are not hindered.

Next, the reasons for regulating the conditions in the production method for obtaining a high strength steel sheet according to the present invention are as follows.

In hot rolling, hot rolling is applied in the temperature range of the $Ar_3$ transformation temperature or higher in order to prevent strain from being excessively imposed on ferrite grains and workability from deteriorating. However, when the temperature is excessively high, crystal grains recrystallized after annealing and the complex precipitates or the crystals of Mg coarsen excessively and therefore it is preferable that the temperature is 940° or lower. With regard to a coiling temperature, when a coiling temperature is high, recrystallization and crystal grain growth are accelerated and the improvement of workability is expected but, adversely, the formation of scales during hot rolling is accelerated, thus pickling performance deteriorates, ferrite and pearlite form in layers and, by so doing, C disperses unevenly. Therefore, a coiling temperature is set at 550° C. or lower. On the other hand, when a coiling temperature is too low, a steel sheet hardens and thus the load of cold rolling increases. Therefore, a coiling temperature is set at 400° C. or higher.

In cold rolling after pickling, when a reduction ratio is low, the shape correction of a steel sheet is hardly performed. Therefore, the lower limit of a reduction ratio is set at 30%. On the other hand, when a steel sheet is cold rolled at a reduction ratio exceeding 70%, cracks are generated at the edges of the steel sheet and the shapes thereof becomes unstable. Therefore, the upper limit of a reduction ratio is set at 70%.

In an annealing process, annealing is applied in the temperature range from the $Ac_1$ transformation temperature to the $Ac_3$ transformation temperature+100° C. When an annealing temperature is lower than the above range, a structure becomes uneven. On the other hand, when an annealing temperature is higher than the above range, the formation of ferrite is suppressed by the coarsening of austenite and resultantly elongation deteriorates. Further, a preferable annealing temperature is 900° C. or lower from the economic viewpoint.

In this case, it is necessary to retain a steel sheet for 30 sec. or longer in order to eliminate a laminar structure. However, even when a retention time exceeds 30 min., the effect is saturated and productivity rather deteriorates. Therefore, a retention time is regulated in the range from 30 sec. to 30 min.

Figure 3:
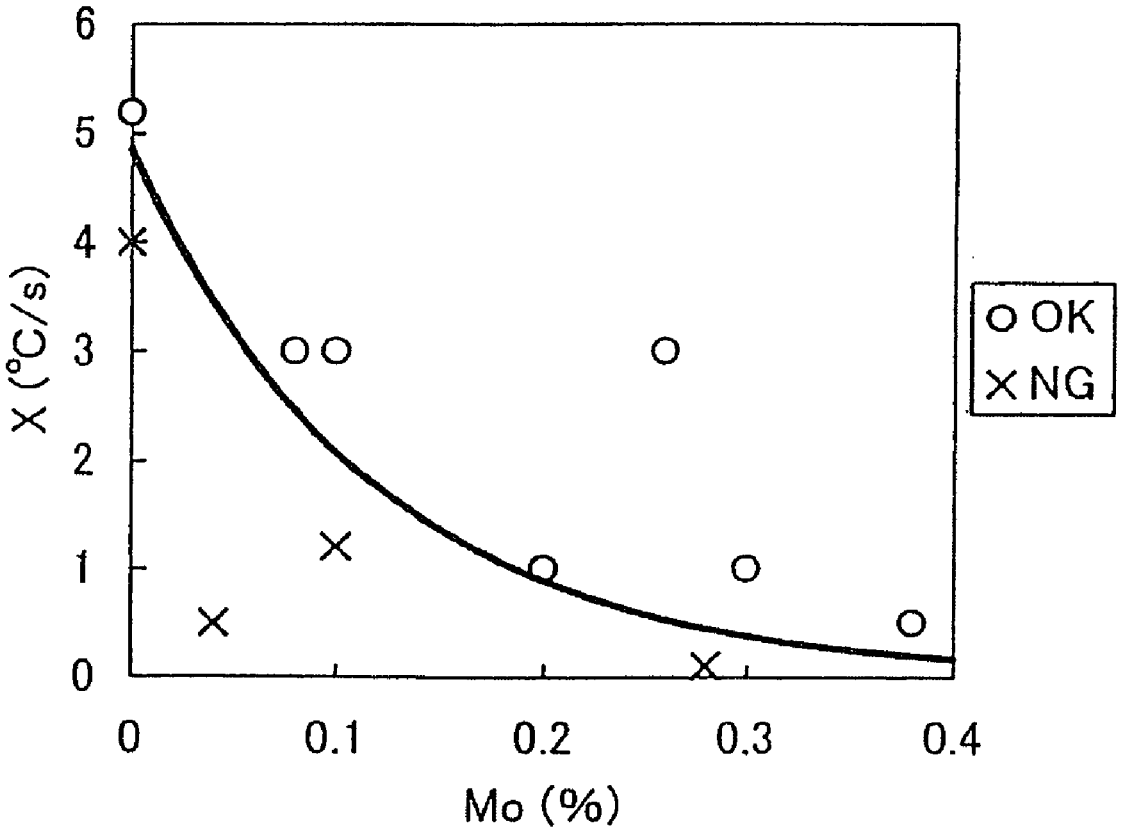
FIG. 3 is a graph showing the relationship between the cooling rate for securing ductility and the chemical components.

Successively, a cooling end temperature is set at 600° C. or lower. When a cooling end temperature exceeds 600° C., austenite tends to remain and the problems in secondary workability and delayed fracture are likely to occur. When a cooling rate is low, pearlite is formed during cooling. Pearlite deteriorates elongation and therefore it is necessary to avoid forming pearlite. The present inventors found that elongation was secured by satisfying the following expression (3) as shown in FIG. 3;

$$X \geqq (Ac_3 - 500)/10^{a} \quad (3)$$

$$a = 0.6[C] + 1.4[Mn] + 3.7[Mo] - 0.87,$$

where, X was a cooling rate in terms of ° C./sec., $Ac_3$ was expressed in terms of ° C., [C] was the amount of C, [Mn] that of Mn and [Mo] that of Mo, each in terms of mass %.

In the present invention, even though tempering treatment is applied at 600° C. or lower after the above heat treatment with the aim of improving hole expansibility and brittleness, the effects of the present invention are not affected.

EXAMPLES

Steels having the chemical components shown in Table 1 were produced in a vacuum melting furnace, cooled and solidified, thereafter reheated to 1,200° C., finish rolled at 880° C., and cooled. After the cooling, by retaining the steel sheets for 1 hr. at 500° C., the coiling heat treatment at hot rolling was duplicated. The produced hot-rolled steel sheets were ground to remove scales and then cold rolled at a reduction ratio of 60%.

Thereafter, by using a continuous annealing simulator, the cold-rolled steel sheets were annealed for 60 sec. at 770° C., cooled to 350° C., successively retained for 10 to 600 sec. at that temperature, and then cooled again to room temperature.

Tensile properties were evaluated by applying tension in the L direction to a JIS #5 tensile test piece, and the case where a value TS (MPa)×EL (%) was 16,000 MPa % or more was regarded as good. A metallographic structure was observed with an optical microscope. Ferrite was observed by nitral etching and martensite was observed by LePera etching.

With regard to plating performance, by using a hot-dip galvanizing simulator, the cold-rolled steel sheets were annealed under the same conditions as above, and then subjected to hot-dip galvanizing. Thereafter, the deposition state of plated layers was observed visually, and the case where a plating layer was deposited evenly over 90% of the steel sheet surface area was evaluated as good (○) and the case where a plated layer partially had defects was evaluated as bad (X). With regard to chemical conversion treatment, the steel sheets were processed with an ordinary phosphate treatment agent for an automobile (Bt 3080, made by Nihon Parkerizing Co., Ltd.) under the standard specifications. Thereafter, the features of the chemical conversion films were observed visually and with a scanning electron microscope, and the case where a chemical conversion film covered the steel sheet substrate densely was evaluated as good (○) and the case where a chemical conversion film had partial defects was evaluated as bad (X).

As can be seen from the results shown in Table 2, the present invention makes it possible to produce a high strength steel sheet excellent in the performance of hot-dip galvanization and chemical conversion treatment and moreover excellent in the balance between strength and ductility.

On the other hand, in the cases of the comparative examples wherein the chemical components thereof deviate from the ranges specified in the present invention and the comparative examples Nos. 61 and 62 wherein the amounts of Al deviate from the ranges stipulated by the expression (1) as shown in Table 2, the values TS×EL that represent the balance between strength and ductility are less than 18,000 MPa % or otherwise the evaluations of the performance of plating and chemical conversion treatment are indicated by the marks X. Further, in the cases of the comparative examples Nos. 63 and 64 that do not satisfy the expression (2), the evaluations of the performance of plating and chemical conversion treatment are indicated by the marks X. Furthermore, in the cases of the comparative examples Nos. 65 and 66 that do not satisfy the expression (3), the values of TS×EL that represent the balance between strength and ductility are less than 18,000 MPa %.

TABLE 1

| Steel code | | C | Si | Mn | P | S | N | Al | Mo | V | Ti | Nb |
|---|---|---|---|---|---|---|---|---|---|---|---|---|
| 1 | Invention example | 0.031 | 0.131 | 1.74 | 0.006 | 0.002 | 0.0051 | 1.012 | 0.22 | — | — | — |
| 2 | Invention example | 0.035 | 0.122 | 2.67 | 0.015 | 0.002 | 0.0064 | 0.749 | 0.05 | — | — | — |
| 3 | Invention example | 0.049 | 0.161 | 2.50 | 0.012 | 0.006 | 0.0061 | 0.457 | 0.15 | — | — | — |
| 4 | Invention example | 0.060 | 0.168 | 1.01 | 0.003 | 0.007 | 0.0020 | 0.426 | — | — | — | — |
| 5 | Invention example | 0.063 | 0.006 | 1.40 | 0.030 | 0.008 | 0.0033 | 1.190 | 0.11 | — | — | — |
| 6 | Invention example | 0.068 | 0.180 | 1.69 | 0.011 | 0.010 | 0.0087 | 0.952 | 0.22 | — | — | — |
| 7 | Invention example | 0.076 | 0.033 | 1.05 | 0.023 | 0.005 | 0.0078 | 1.185 | 0.15 | — | — | — |
| 8 | Invention example | 0.079 | 0.130 | 1.21 | 0.016 | 0.001 | 0.0040 | 0.748 | 0.05 | — | — | — |
| 9 | Invention example | 0.080 | 0.070 | 1.23 | 0.057 | 0.002 | 0.0009 | 1.179 | 0.00 | — | — | — |
| 10 | Invention example | 0.081 | 0.117 | 1.34 | 0.009 | 0.005 | 0.0090 | 1.041 | 0.25 | — | — | — |
| 11 | Invention example | 0.088 | 0.205 | 1.18 | 0.056 | 0.003 | 0.0015 | 0.677 | 0.11 | — | — | — |
| 12 | Invention example | 0.095 | 0.150 | 2.09 | 0.008 | 0.007 | 0.0029 | 0.892 | 0.21 | — | — | — |
| 13 | Invention example | 0.100 | 0.120 | 0.53 | 0.022 | 0.004 | 0.0022 | 0.567 | 0.12 | — | — | — |
| 14 | Invention example | 0.101 | 0.100 | 2.68 | 0.006 | 0.008 | 0.0080 | 1.189 | 0.23 | — | — | — |
| 15 | Invention example | 0.102 | 0.157 | 1.02 | 0.060 | 0.007 | 0.0034 | 0.639 | 0.31 | — | — | — |
| 16 | Invention example | 0.118 | 0.128 | 2.99 | 0.054 | 0.001 | 0.0024 | 0.962 | 0.05 | — | — | — |
| 17 | Invention example | 0.119 | 0.179 | 1.15 | 0.041 | 0.006 | 0.0037 | 0.880 | 0.11 | — | — | 0.01 |
| 18 | Invention example | 0.128 | 0.244 | 2.03 | 0.027 | 0.004 | 0.0041 | 0.442 | 0.15 | — | — | 0.01 |
| 19 | Invention example | 0.128 | 0.213 | 1.93 | 0.036 | 0.007 | 0.0036 | 0.828 | 0.12 | — | — | — |
| 20 | Invention example | 0.142 | 0.100 | 2.95 | 0.001 | 0.003 | 0.0085 | 1.180 | 0.31 | — | 0.03 | — |
| 21 | Invention example | 0.160 | 0.100 | 2.41 | 0.059 | 0.009 | 0.0064 | 1.190 | 0.00 | — | — | — |
| 22 | Invention example | 0.163 | 0.048 | 2.19 | 0.042 | 0.005 | 0.0007 | 1.190 | 0.00 | — | — | — |
| 23 | Invention example | 0.164 | 0.114 | 1.54 | 0.013 | 0.009 | 0.0023 | 1.163 | 0.11 | — | 0.08 | — |

TABLE 1-continued

| | | | | | | | | | | | | |
|---|---|---|---|---|---|---|---|---|---|---|---|---|
| 24 | Invention example | 0.166 | 0.170 | 2.35 | 0.026 | 0.007 | 0.0090 | 0.527 | 0.00 | — | — | — |
| 25 | Invention example | 0.173 | 0.100 | 1.24 | 0.050 | 0.005 | 0.0063 | 1.100 | 0.15 | 0.05 | — | — |
| 26 | Invention example | 0.174 | 0.070 | 2.02 | 0.053 | 0.005 | 0.0065 | 1.170 | 0.22 | — | — | — |
| 27 | Invention example | 0.192 | 0.149 | 2.37 | 0.038 | 0.003 | 0.0085 | 0.360 | 0.31 | — | — | 0.02 |
| 28 | Comparative example | 0.009 | 0.202 | 1.03 | 0.007 | 0.010 | 0.0063 | 1.178 | 0.05 | — | — | — |
| 29 | Comparative example | 0.320 | 0.113 | 2.92 | 0.003 | 0.006 | 0.0007 | 0.462 | 0.12 | — | — | — |
| 30 | Comparative example | 0.166 | 0.323 | 2.64 | 0.056 | 0.009 | 0.0049 | 0.894 | 0.15 | — | — | — |
| 31 | Comparative example | 0.113 | 0.315 | 0.09 | 0.049 | 0.001 | 0.0006 | 0.527 | 0.13 | — | — | — |
| 32 | Comparative example | 0.164 | 0.285 | 3.14 | 0.020 | 0.004 | 0.0041 | 1.147 | 0.21 | — | — | — |
| 33 | Comparative example | 0.125 | 0.267 | 2.06 | 0.070 | 0.003 | 0.0009 | 0.337 | 0.16 | — | — | 0.01 |
| 34 | Comparative example | 0.058 | 0.131 | 2.50 | 0.002 | 0.020 | 0.0059 | 0.377 | 0.23 | — | — | — |
| 35 | Comparative example | 0.031 | 0.145 | 1.15 | 0.011 | 0.010 | 0.0200 | 0.273 | — | — | — | 0.02 |
| 36 | Comparative example | 0.196 | 0.187 | 1.95 | 0.018 | 0.004 | 0.0093 | 0.190 | 0.15 | — | — | — |
| 37 | Comparative example | 0.193 | 0.220 | 2.78 | 0.005 | 0.003 | 0.0022 | 1.810 | 0.22 | — | — | — |

| Steel code | | Ca | B | REM | TS | EL | TS × EL | Performance of galvanization and chemical conversion treatment |
|---|---|---|---|---|---|---|---|---|
| 1 | Invention example | — | — | — | 577 | 33.2 | 19156 | ○ |
| 2 | Invention example | — | — | — | 576 | 32.5 | 18720 | ○ |
| 3 | Invention example | — | — | — | 585 | 31.2 | 18252 | ○ |
| 4 | Invention example | — | — | — | 622 | 29.5 | 18349 | ○ |
| 5 | Invention example | — | — | — | 612 | 29.8 | 18238 | ○ |
| 6 | Invention example | — | — | — | 635 | 29.4 | 18669 | ○ |
| 7 | Invention example | — | — | — | 622 | 30.1 | 18722 | ○ |
| 8 | Invention example | 0.003 | — | — | 638 | 28.5 | 18183 | ○ |
| 9 | Invention example | — | — | — | 652 | 28.1 | 18321 | ○ |
| 10 | Invention example | — | — | — | 685 | 27.2 | 18632 | ○ |
| 11 | Invention example | — | — | — | 734 | 26.4 | 19378 | ○ |
| 12 | Invention example | — | — | — | 795 | 24.5 | 19478 | ○ |
| 13 | Invention example | — | — | — | 789 | 24.2 | 19094 | ○ |
| 14 | Invention example | — | — | — | 825 | 22.2 | 18315 | ○ |
| 15 | Invention example | — | — | — | 788 | 23.5 | 18518 | ○ |
| 16 | Invention example | — | — | — | 853 | 21.5 | 18340 | ○ |
| 17 | Invention example | — | 0.0010 | — | 832 | 22.4 | 18637 | ○ |
| 18 | Invention example | — | — | — | 874 | 21.2 | 18529 | ○ |
| 19 | Invention example | — | — | 0.0020 | 873 | 20.1 | 17547 | ○ |
| 20 | Invention example | — | — | — | 953 | 19.2 | 18298 | ○ |
| 21 | Invention example | — | 0.0008 | — | 987 | 18.5 | 18260 | ○ |
| 22 | Invention example | — | — | — | 979 | 17.2 | 16849 | ○ |
| 23 | Invention example | — | — | — | 988 | 16.5 | 16302 | ○ |
| 24 | Invention example | — | — | — | 993 | 18.3 | 18172 | ○ |
| 25 | Invention example | — | — | — | 1005 | 18.0 | 18090 | ○ |
| 26 | Invention example | — | — | — | 1012 | 17.9 | 18115 | ○ |
| 27 | Invention example | — | — | — | 1033 | 17.5 | 18078 | ○ |
| 28 | Comparative example | — | — | — | 335 | 33.2 | 11122 | ○ |
| 29 | Comparative example | — | — | — | 1623 | 9.2 | 14932 | ○ |
| 30 | Comparative example | — | 0.0006 | — | 985 | 19.5 | 19208 | X |
| 31 | Comparative example | — | — | — | 885 | 16.4 | 14514 | X |
| 32 | Comparative example | — | — | — | 1235 | 10.2 | 12597 | ○ |
| 33 | Comparative example | — | — | — | 795 | 20.1 | 15980 | ○ |
| 34 | Comparative example | — | — | — | 587 | 26.5 | 15556 | ○ |
| 35 | Comparative example | — | — | — | 557 | 28.4 | 15819 | ○ |
| 36 | Comparative example | — | — | — | 1470 | 7.1 | 10437 | ○ |
| 37 | Comparative example | — | — | — | 1480 | 11.2 | 16576 | X |

TABLE 2

| Steel code | | Target TS | C | Si | Mn | P | S | N | Al | Mo | V | Ti | Nb | Ca | B | REM |
|---|---|---|---|---|---|---|---|---|---|---|---|---|---|---|---|---|
| 38 | Invention example | 550 | 0.030 | 0.177 | 1.11 | 0.016 | 0.009 | 0.005 | 0.953 | 0.02 | — | — | — | — | — | — |
| 39 | Invention example | 560 | 0.032 | 0.186 | 2.58 | 0.029 | 0.006 | 0.003 | 0.930 | 0.01 | — | — | — | — | — | — |
| 40 | Invention example | 570 | 0.044 | 0.100 | 2.34 | 0.039 | 0.002 | 0.008 | 0.299 | 0.15 | — | — | — | — | — | — |
| 41 | Invention example | 580 | 0.058 | 0.171 | 2.06 | 0.056 | 0.007 | 0.003 | 0.970 | 0.21 | — | 0.01 | — | — | — | — |
| 42 | Invention example | 580 | 0.058 | 0.160 | 1.10 | 0.033 | 0.002 | 0.008 | 0.896 | 0.16 | — | — | — | — | — | — |
| 43 | Invention example | 590 | 0.071 | 0.196 | 1.42 | 0.037 | 0.003 | 0.005 | 0.547 | 0.23 | — | — | — | 0.0010 | — | — |
| 44 | Invention example | 640 | 0.082 | 0.089 | 1.15 | 0.016 | 0.004 | 0.005 | 1.139 | 0.14 | — | — | — | — | — | — |
| 45 | Invention example | 680 | 0.082 | 0.081 | 2.63 | 0.040 | 0.001 | 0.003 | 1.049 | 0.31 | — | — | — | — | — | — |
| 46 | Invention example | 700 | 0.093 | 0.055 | 1.84 | 0.007 | 0.006 | 0.007 | 0.500 | 0.28 | — | — | 0.01 | — | — | — |
| 47 | Invention example | 760 | 0.100 | 0.013 | 1.10 | 0.002 | 0.008 | 0.004 | 0.815 | 0.31 | — | — | — | — | — | — |
| 48 | Invention example | 780 | 0.110 | 0.122 | 2.64 | 0.057 | 0.009 | 0.002 | 0.731 | 0.15 | — | — | — | — | — | — |
| 49 | Invention example | 800 | 0.120 | 0.084 | 1.17 | 0.010 | 0.010 | 0.004 | 0.866 | 0.13 | — | — | — | — | — | — |
| 50 | Invention example | 840 | 0.120 | 0.148 | 1.19 | 0.016 | 0.008 | 0.006 | 1.000 | 0.28 | — | — | — | — | — | — |
| 51 | Invention example | 900 | 0.134 | 0.047 | 1.19 | 0.042 | 0.010 | 0.007 | 1.114 | 0.15 | — | — | — | — | — | — |
| 52 | Invention example | 920 | 0.140 | 0.042 | 1.71 | 0.021 | 0.006 | 0.005 | 0.780 | — | — | — | 0.02 | — | — | — |
| 53 | Invention example | 950 | 0.142 | 0.116 | 1.27 | 0.046 | 0.007 | 0.006 | 0.850 | — | — | — | — | — | — | — |
| 54 | Invention example | 980 | 0.150 | 0.107 | 1.76 | 0.059 | 0.006 | 0.009 | 0.880 | — | — | — | — | — | — | — |
| 55 | Invention example | 1280 | 0.210 | 0.153 | 1.20 | 0.025 | 0.005 | 0.002 | 0.780 | 0.21 | — | — | — | — | — | — |
| 56 | Invention example | 1320 | 0.235 | 0.176 | 2.73 | 0.051 | 0.008 | 0.004 | 0.850 | 0.15 | — | — | — | — | 0.0008 | — |
| 57 | Invention example | 950 | 0.122 | 0.275 | 1.27 | 0.046 | 0.007 | 0.006 | 0.650 | 0.02 | 0.05 | — | — | — | — | — |
| 58 | Invention example | 1180 | 0.150 | 0.107 | 2.65 | 0.059 | 0.006 | 0.009 | 0.880 | 0.15 | — | — | — | — | — | — |
| 59 | Invention example | 1200 | 0.210 | 0.299 | 1.20 | 0.025 | 0.005 | 0.002 | 0.600 | 0.25 | — | — | — | — | — | — |
| 60 | Invention example | 1480 | 0.289 | 0.186 | 2.06 | 0.052 | 0.004 | 0.008 | 0.910 | 0.23 | — | — | — | — | — | — |
| 61 | Comparative example | 720 | 0.099 | 0.005 | 1.55 | 0.046 | 0.002 | 0.003 | 0.210 | 0.12 | — | — | — | — | — | — |
| 62 | Comparative example | 880 | 0.130 | 0.186 | 2.39 | 0.051 | 0.006 | 0.003 | 1.100 | 0.02 | — | — | 0.01 | — | — | — |
| 63 | Comparative example | 980 | 0.121 | 0.120 | 2.68 | 0.005 | 0.003 | 0.003 | 0.700 | 0.03 | — | — | — | — | 0.0010 | — |
| 64 | Comparative example | 980 | 0.118 | 0.114 | 2.23 | 0 | 0.008 | 0.004 | 1.100 | 0.15 | — | — | — | — | 0.0018 | — |
| 65 | Comparative example | 980 | 0.150 | 0.111 | 1.12 | 0 | 0.008 | 0.004 | 0.512 | 0.08 | — | — | 0.02 | — | — | — |
| 66 | Comparative example | 980 | 0.115 | 0.050 | 1.84 | 0.030 | 0.005 | 0.003 | 0.456 | — | — | — | — | — | — | — |

| Steel code | Left-hand side of expression (1) | Al | Judgment | Right-hand side of expression (1) | Left-hand side of expression (2) | Judgment | Right-hand side of expression (2) | Left-hand side of expression (3) | Judgment | Cooling rate | TS | EL | TS × EL | Performance of galvanization and chemical conversion treatment |
|---|---|---|---|---|---|---|---|---|---|---|---|---|---|---|
| 38 | 0.079 | 0.953 | ○ | 0.970 | 1.30 | ○ | 2.9 | 124.7 | ○ | 180 | 549 | 33.1 | 18172 | ○ |
| 39 | 0.080 | 0.930 | ○ | 0.941 | 2.77 | ○ | 2.9 | 1.1 | ○ | 11 | 568 | 32.5 | 18460 | ○ |
| 40 | 0.120 | 0.299 | ○ | 1.199 | 2.40 | ○ | 2.9 | 0.5 | ○ | 4 | 582 | 31.9 | 18566 | ○ |
| 41 | 0.096 | 0.970 | ○ | 0.987 | 2.26 | ○ | 2.9 | 1.1 | ○ | 10 | 591 | 30.9 | 18262 | ○ |
| 42 | 0.100 | 0.896 | ○ | 1.019 | 1.28 | ○ | 2.9 | 36.4 | ○ | 156 | 584 | 31.2 | 18221 | ○ |
| 43 | 0.091 | 0.547 | ○ | 0.912 | 1.53 | ○ | 2.9 | 5.6 | ○ | 71 | 605 | 29.9 | 18090 | ○ |
| 44 | 0.159 | 1.139 | ○ | 1.232 | 1.38 | ○ | 2.9 | 38.8 | ○ | 152 | 632 | 30.1 | 19023 | ○ |
| 45 | 0.182 | 1.049 | ○ | 1.258 | 2.84 | ○ | 2.9 | 0.1 | ○ | 10 | 688 | 28.7 | 19746 | ○ |
| 46 | 0.202 | 0.500 | ○ | 1.334 | 1.94 | ○ | 2.9 | 0.8 | ○ | 12 | 695 | 27.2 | 18904 | ○ |
| 47 | 0.249 | 0.815 | ○ | 1.462 | 1.26 | ○ | 2.9 | 8.6 | ○ | 152 | 743 | 24.8 | 18426 | ○ |
| 48 | 0.214 | 0.731 | ○ | 1.135 | 2.78 | ○ | 2.9 | 0.2 | ○ | 3 | 812 | 23.2 | 18838 | ○ |
| 49 | 0.239 | 0.866 | ○ | 1.247 | 1.34 | ○ | 2.9 | 31.8 | ○ | 154 | 825 | 22.8 | 18810 | ○ |
| 50 | 0.233 | 1.000 | ○ | 1.057 | 1.39 | ○ | 2.9 | 9.1 | ○ | 156 | 852 | 21.5 | 18318 | ○ |
| 51 | 0.303 | 1.114 | ○ | 1.360 | 1.41 | ○ | 2.9 | 28.9 | ○ | 142 | 905 | 20.1 | 18191 | ○ |
| 52 | 0.315 | 0.780 | ○ | 1.374 | 1.86 | ○ | 2.9 | 15.3 | ○ | 71 | 899 | 20.5 | 18430 | ○ |
| 53 | 0.300 | 0.850 | ○ | 1.153 | 1.44 | ○ | 2.9 | 68.3 | ○ | 102 | 934 | 19.5 | 18213 | ○ |
| 54 | 0.318 | 0.880 | ○ | 1.180 | 1.94 | ○ | 2.9 | 14.0 | ○ | 75 | 1024 | 18.2 | 18637 | ○ |
| 55 | 0.446 | 0.780 | ○ | 1.041 | 1.36 | ○ | 2.9 | 11.9 | ○ | 152 | 1320 | 14.9 | 19668 | ○ |
| 56 | 0.456 | 0.850 | ○ | 0.972 | 3.30 | ○ | 2.9 | 0.1 | ○ | 4 | 1400 | 13.5 | 18900 | ○ |
| 57 | 0.235 | 0.650 | ○ | 0.675 | 1.40 | ○ | 2.9 | 52.9 | ○ | 124 | 965 | 19.9 | 19204 | ○ |
| 58 | 0.416 | 0.880 | ○ | 1.180 | 2.83 | ○ | 2.9 | 0.2 | ○ | 5 | 1230 | 15.8 | 19434 | ○ |
| 59 | 0.347 | 0.600 | ○ | 0.603 | 1.32 | ○ | 2.9 | 7.6 | ○ | 71 | 1220 | 15.3 | 18666 | ○ |
| 60 | 0.531 | 0.910 | ○ | 0.942 | 2.24 | ○ | 2.9 | 0.6 | ○ | 75 | 1520 | 12.2 | 18544 | ○ |
| 61 | 0.232 | 0.210 | ← | 1.485 | 1.59 | ○ | 2.9 | 6.6 | ○ | 71 | 750 | 18.1 | 13575 | ○ |
| 62 | 0.237 | 1.100 | → | 0.941 | 2.61 | ○ | 2.9 | 1.7 | ○ | 5 | 899 | 20.2 | 18160 | X |
| 63 | 0.313 | 0.700 | ○ | 1.140 | 3.32 | X | 2.9 | 0.5 | ○ | 5 | 992 | 19.1 | 18947 | X |
| 64 | 0.315 | 1.100 | ○ | 1.158 | 3.35 | X | 2.9 | 1.0 | ○ | 8 | 1011 | 18.0 | 18198 | X |
| 65 | 0.316 | 0.512 | ○ | 1.167 | 1.22 | ○ | 2.9 | 42.2 | X | 31 | 1006 | 12.6 | 12676 | ○ |
| 66 | 0.341 | 0.456 | ○ | 1.350 | 1.93 | ○ | 2.9 | 8.3 | X | 4 | 1022 | 14.5 | 14819 | ○ |

INDUSTRIAL APPLICABILITY

The present invention makes it possible, in a DP steel having a low yield stress, to realize a hot-dip galvanized high-strength steel sheet that is excellent in formability and assures better elongation than before and a method for producing the steel sheet in an industrial scale by controlling the balance among Si, Al and TS in specific ranges and, in particular, by adjusting the amount of addition of Al.

The invention claimed is:

1. A method for producing a high strength steel sheet excellent in formability, compatible with chemical conversion coating treatment and hot-dip galvanizing, wherein said steel sheet comprises, in mass, 0.03 to 0.20% C,
0.005 to 0.3% Si,
1.0 to 3.1% Mn,
0.001 to 0.06% P,
0.001 to 0.01% S,
0.0005 to 0.01% N,
0.2 to 1.2% Al, and
not more than 0.5% Mo, with the balance consisting of Fe and unavoidable impurities; wherein the amounts of Si and Al in mass % and a target strength (TS) of said steel sheet satisfy the following expression (1); and a metallographic structure of said steel sheet contains ferrite and martensite without containing retained austenite and the steel sheet has a tensile strength of 980 MPa or more and a value of TS×El of 16,000 or more;

$$(0.0012\times[\text{target strength TS}]-0.29-[\text{Si}])/2.45<\text{Al}<1.5-3\times[\text{Si}] \quad (1)$$

where [target strength TS] is a target strength of said steel sheet in terms of MPa and [Si] is an amount of Si in terms of mass %, said method comprising: hot rolling at a finishing temperature of the $Ar_3$ transformation temperature or higher; coiling at 400° C. to 550° C.; successively applying ordinary pickling; thereafter primary cold rolling at a reduction ratio of 30 to 70%; then recrystallization annealing in a continuous annealing process; and successively skin-pass rolling.

2. The method for producing a high strength steel sheet according to claim 1, wherein said annealing comprises: heating to a temperature in the range from an $Ac_1$ transformation temperature to an $Ac_3$ transformation temperature +100° C.; retaining for 30 sec, to 30 min.; and thereafter cooling to a temperature range of 600° C. or lower at a cooling rate of not less than X° C./sec., X satisfying the following expression (3), $$X\geqq(Ac_3-500)/10^{a} \quad (3)$$

$$a=0.6[\text{C}]+1.4[\text{Mn}]+3.7[\text{Mo}]-0.87,$$

where, X is a cooling rate in terms of ° C./sec., $Ac_3$ is expressed in terms of ° C., [C] is an amount of C, [Mn] is an amount of Mn, and [Mo] is an amount of Mo, each in terms of mass %.

3. A method for producing a high strength steel sheet excellent in formability, resistant to delayed fracture and compatible with chemical conversion coating treatment and hot-dip galvanizing, said steel sheet consisting essentially of, in mass, 0.03 to 0.20% C,
0.107 to 0.3% Si,
1.0 to 3.1% Mn,
0.001 to 0.06% P,
0.001 to 0.01% S,
0.0005 to 0.01% N,
0.2 to 1.2% Al,
and not more than 0.5% Mo,
at least one of 0.01 to 0.1% Ti, 0.005 to 0.05 Nb, and 0.01 to 0.1% V;

with the balance consisting of Fe and unavoidable impurities; wherein the amounts of Si and Al in mass % and a target strength (TS) of said steel sheet satisfy the following expression (1); and a metallographic structure of said steel sheet contains ferrite and martensite without containing retained austenite and has a tensile strength of 980 MPa or more and a value of TS×El of 16,000 or more;

$$(0.0012\times[\text{target strength TS}]-0.29-[\text{Si}])/2.45<\text{Al}<1.5-3\times[\text{Si}] \quad (1)$$

where, [target strength TS] is a designed strength of said steel sheet in terms of MPa and [Si] is an amount of Si in terms of mass %; said method comprising: hot rolling at a finishing temperature of an $Ar_3$ transformation temperature or higher; coiling at 400° C. to 550° C.; successively applying ordinary pickling; thereafter primary cold rolling at a reduction ratio of 30 to 70%; then recrystallization annealing in a continuous annealing process; and successively skin-pass rolling.

4. The method for producing a high strength steel sheet according to claim 1, wherein said steel sheet comprises, in mass, 0.107 to 0.3% Si.

5. The method for producing a high strength steel sheet according to claim 1, wherein said steel sheet further comprises at least one of, in mass, 0.01 to 0.1% V, 0.01 to 0.1% Ti, and 0.005 to 0.05% Nb.

6. The method for producing a high strength steel sheet according to claim 1, wherein said steel sheet further comprises 0.0005 to 0.002 mass % B; and satisfying the following expression (2), $$500\times[\text{B}]+[\text{Mn}]+0.2[\text{Al}]<2.9 \quad (2)$$

where, [B] is an amount of B, [Mn] is an amount of Mn, and [Al] is an amount of Al, each in terms of mass %.

7. The method for producing a high strength steel sheet according to claim 1, wherein said steel sheet further comprises, in mass, one or both of 0.0005 to 0.005% Ca and 0.0005 to 0.005% REM.

8. The method for producing a high strength steel sheet according to claim 1, wherein said steel sheet comprises Mn in an amount from 2.02% to 3.1%.

9. The method for producing a high strength steel sheet according to claim 1, wherein said steel sheet does not contain any one of Nb, V, B and Ti.

* * * * *